United States Patent [19]

Stokes et al.

[11] Patent Number: 4,922,999

[45] Date of Patent: May 8, 1990

[54] RADIATOR WITH LEAK DETECTING AND LEAK-ISOLATING SYSTEM

[76] Inventors: Bennie J. Stokes, 1031 W. Verdine; Dyrell K. Stokes, Rte. 3, Box 1354, both of Sulphur, La. 70663

[21] Appl. No.: 347,018

[22] Filed: May 4, 1989

[51] Int. Cl.[5] ..... F28F 11/06

[52] U.S. Cl. ..... 165/40; 165/70; 165/11.1; 165/76; 165/38; 165/101; 165/174

[58] Field of Search ..... 165/40, 70, 11.1, 174, 165/175, 173, 76, 38; 73/40.5 R

[56] References Cited

U.S. PATENT DOCUMENTS

| | | | |
|---|---|---|---|
| 1,397,116 | 11/1921 | Sparks | 165/101 |
| 1,919,190 | 7/1933 | Bancel | 165/70 |
| 2,501,709 | 3/1950 | Booth | 165/38 |
| 2,936,610 | 5/1960 | Schiedel | 73/40 |
| 2,981,095 | 4/1961 | Eshbaugh | 73/40 |
| 3,650,147 | 3/1972 | Moyer | 73/49.7 |
| 3,774,678 | 11/1973 | Glorisi | 165/101 |
| 4,102,178 | 7/1978 | Mercik, Jr. et al. | 73/49.7 |
| 4,235,100 | 11/1980 | Branchini | 73/49.7 |
| 4,342,220 | 8/1982 | Catchpole et al. | 73/49.7 |
| 4,458,523 | 7/1984 | Moyer | 73/49.7 |
| 4,667,507 | 5/1987 | Eriksson | 73/49.7 |
| 4,738,304 | 4/1988 | Chalmers et al. | 165/70 |
| 4,753,289 | 6/1988 | Avrea | 165/11.1 |

FOREIGN PATENT DOCUMENTS

| | | | |
|---|---|---|---|
| 2402396 | 7/1975 | Fed. Rep. of Germany | 73/40.5 R |
| 685691 | 7/1930 | France | 165/76 |
| 23798 | 2/1982 | Japan | 165/11.1 |
| 142481 | 1/1921 | United Kingdom | 165/76 |
| 572889 | 10/1945 | United Kingdom | 165/70 |

*Primary Examiner*—John Ford

*Attorney, Agent, or Firm*—Fleit, Jacobson, Cohn, Price, Holman & Stern

[57] ABSTRACT

A radiator is provided including a tube core having opposite ends opening into and from which corresponding end tanks are supported. The tube core is divided into a plurality of discrete tube core sections and the end tanks each include a plurality of discrete secondary compartments into which the corresponding ends of the tube core sections open. The end tanks also include primary compartments therein into and from which heat transfer liquid is received and discharged and communication structure is provided communicating each of the secondary compartments with the corresponding primary compartment for liquid coolant flow there between. The engine cooling system of the instant invention utilizes a coolant radiator including a plurality of relatively isolated radiator sections and structure is provided operative (responsive to an elevated coolant temperature alarm or a low level engine coolant alarm) to isolate each radiator section from the other radiator sections, pressure test each radiator section, maintain a radiator section failing the pressure test isolated from the remainder of the cooling system while allowing the radiator sections passing the pressure test to again be opened to the remainder of the cooling system exclusive of the pressure test failing radiator section and then add liquid coolant to the system to replace coolant lost therefrom by the pressure test failing isolated radiator section.

12 Claims, 2 Drawing Sheets

RADIATOR WITH LEAK DETECTING AND LEAK-ISOLATING SYSTEM

BACKGROUND OF THE INVENTION

1. Field of the Invention

Vehicle engine cooling systems are critical to continued operation of the engines and one of the most problematical portions of an engine cooling system is the heat exchanger or radiator thereof. One or two tubes of a radiator may be damaged by impact thereon by a foreign object such as a rock (or bullet) or by metal or solder joint fatigue or corrosion. One or two leaking tubes ultimately will result in excessive of loss of coolant and overheating of the associated engine if operation thereof is not terminated.

Such breakdowns experienced by passenger vehicles are troublesome and usually very expensive if they occur during a long road trip and similar breakdowns experienced by over-the-road trucks also can be very expensive from a repair standpoint and, even more importantly, from a standpoint of equipment and operator downtime. Further, security and VIP carrying vehicles, in many instances, cannot afford avoidable breakdowns of this type.

The engine cooling system of the instant invention utilizes a coolant radiator including a plurality of relatively isolated radiator sections and structure is provided operative (responsive to an elevated coolant temperature alarm or a low level engine coolant alarm) to isolate each radiator section from the other radiator sections, pressure test each radiator section, maintain a radiator section failing the pressure test isolated from the remainder of the cooling system while allowing the radiator sections passing the pressure test to again be opened to the remainder of the cooling system exclusive of the pressure test failing radiator section and then add liquid coolant to the system to replace coolant lost therefrom by the pressure test failing isolated radiator section.

2. Description of Related Art

Various different structures for pressurizing and testing cooling systems heretofore have been provided such as those disclosed in U.S. Pat. Nos. 2,936,610, 2,981,095, 3,650,147, 4,102,178, 4,235,100, 4,342,220, 4,458,523 and 4,667,507. However, these previously known radiator pressurizing and testing structures do not include the overall combination of structural features incorporated in the instant invention.

SUMMARY OF THE INVENTION

A radiator construction is provided including a tube core separated into a plurality of discrete tube core sections and including means for closing off each tube core section and subjecting the same to a pressure test. The tube core sections passing the pressure test are again communicated with the remainder of the cooling system while a tube core section failing the pressure test is maintained isolated from the remainder of the cooling system. Thereafter, liquid coolant may be added to the cooling system to replenish any coolant lost.

The main object of this invention is to provide an engine cooling system which will be capable of isolating a damaged discrete radiator tube core section from the remainder of the coolant system.

Another object of this invention is to provide a cooling system to which liquid coolant from a reserve supply of liquid coolant may be added subsequent to isolation of a damaged discrete radiator tube core section from the remainder of the cooling system.

Still another important object of this invention is to provide an engine cooling system including a radiator and structure by which discrete radiator tube core sections of the radiator may be individually pressure tested for leaks.

Another very important object of this invention is to provide a cooling system in accordance with the preceding objects and which may have a damaged pressure test failing radiator tube core section thereof isolated from the remainder of the cooling system, all while the associated engine remains in operation.

A final object of this invention to be more specifically enumerated herein is to provide a radiator leak detecting and leak isolation system in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
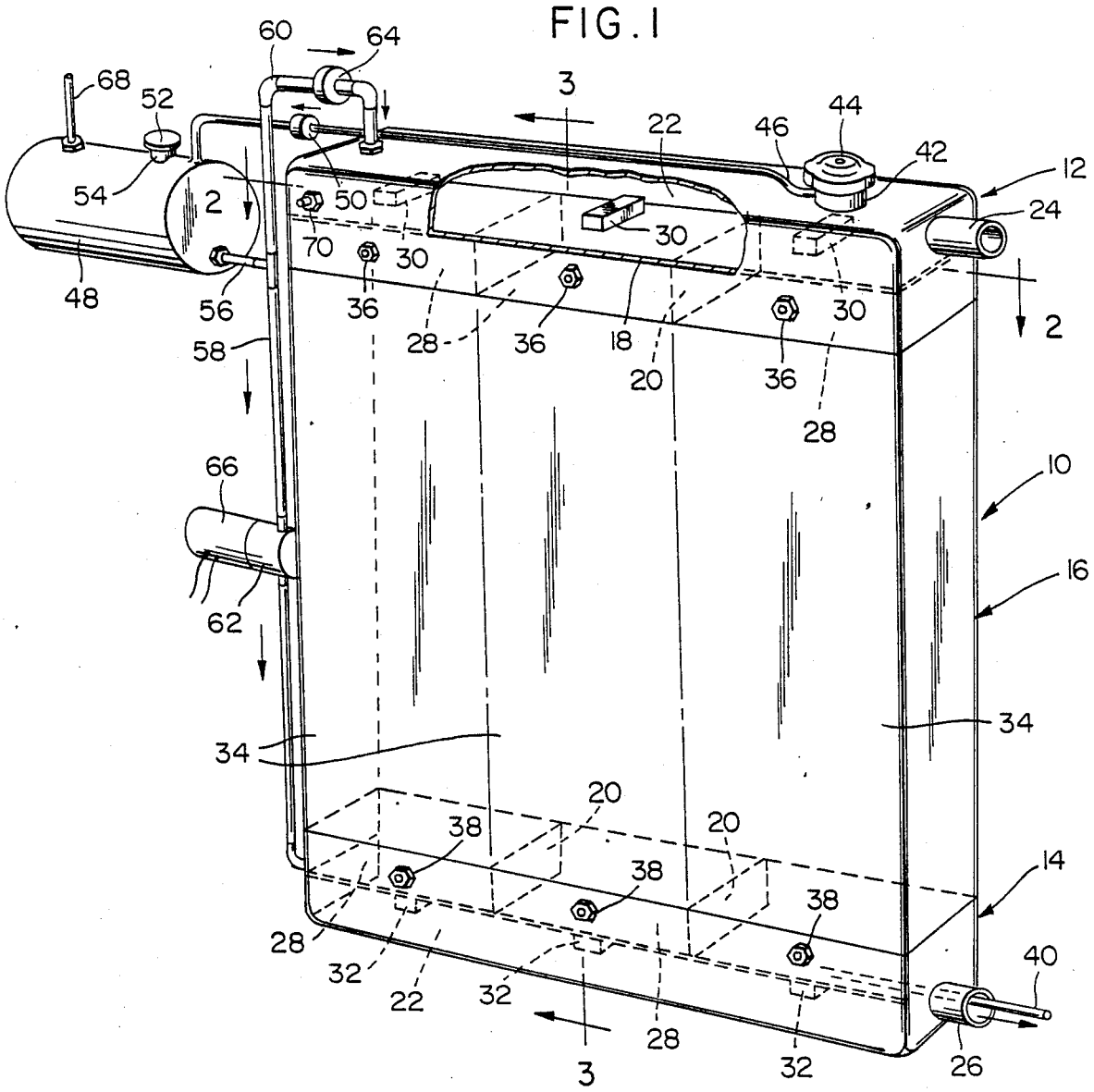
FIG. 1 is a perspective view of a radiator constructed in accordance with the present invention and shown in operative association with a reserve supply of radiator coolant and an air or other pressurized gas system operatively associated with the lower tank assembly of the radiator for pressurizing the individual tube core sections of the radiator.
Figure 2:
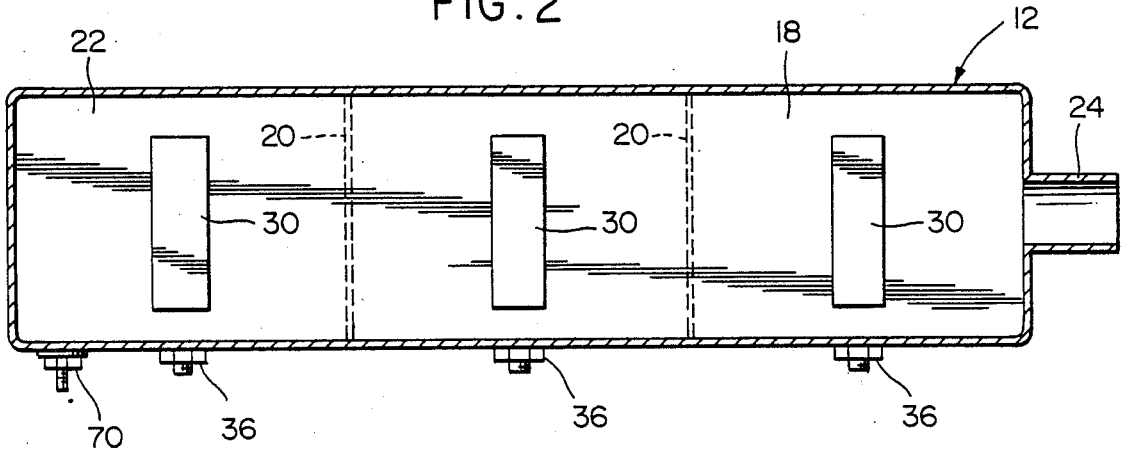
FIG. 2 is an enlarged horizontal sectional view taken substantially upon the plane indicated by the section line 2—2 of FIG. 1.
Figure 3:
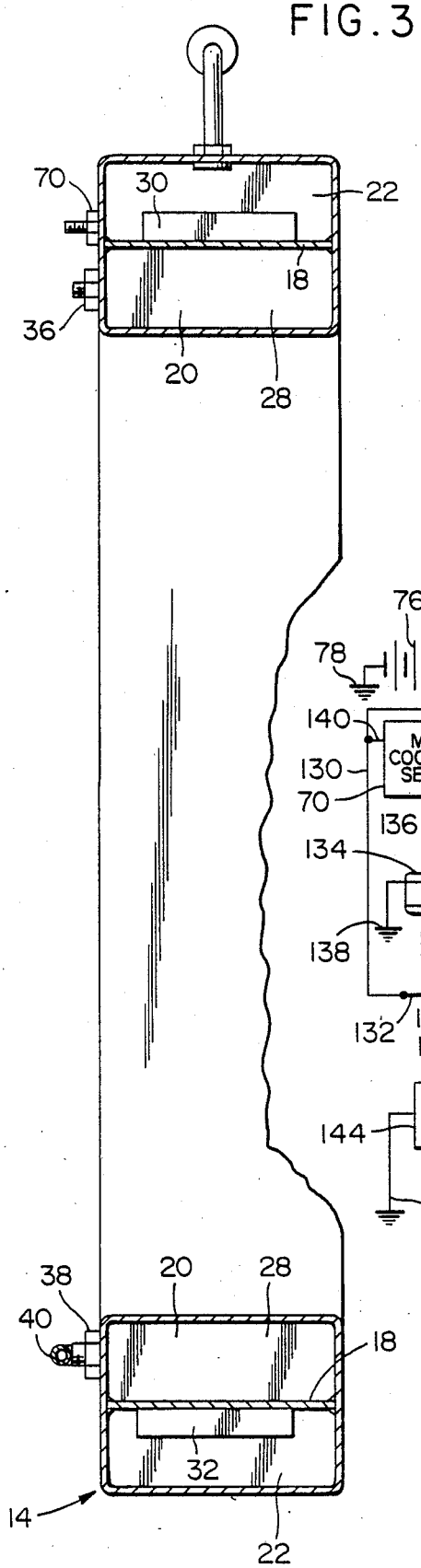
FIG. 3 is an enlarged fragmentary vertical sectional view taken substantially upon the plane indicated by the section line 3—3 of FIG. 1.

Referring now more specifically to the drawings, the numeral 10 generally designates a radiator constructed in accordance with the present invention. The radiator 10 includes a top tank assembly referred to in general by the reference numeral 12, a bottom tank assembly referred to in general by the reference numeral 14 and a tube core assembly referred to in general by the reference numeral 16 extending between and sealed relative to the top and bottom tank assemblies 12 and 14. Of course, the radiator 10 may be of the cross-flow type, if desired, wherein the tube core assembly 16 extends horizontally between opposite side tank assemblies corresponding to the tank assemblies 12 and 14.

The top and bottom tank assemblies 12 and 14 each include a horizontal baffle 18 therein and horizontally spaced vertical baffles 20 therein. The baffles 18 define primary compartments 22 thereabove and therebelow in the tank assemblies 12 and 14, respectively, and a tubular inlet fitting 24 opens into the top tank assembly primary compartment 22 while a tubular outlet fitting 26 opens outwardly of the bottom tank assembly primary compartment 22. The vertical baffles 20 also define a plurality of discrete compartments 28 below and above the horizontal partitions 18 in the top tank assembly 12 and bottom tank assembly 14, respectively, and inlet valves 30 are provided for selectively communicating the top primary compartment 22 with the top discrete compartments 28 while outlet valves 32 are provided for communicating the bottom discrete compartments 28 with the bottom primary compartment 22.

The tube core assembly 16 includes a plurality of discrete tube core sections 34 extending between corresponding top and bottom discrete compartments 28 and air pressure sensors 36 open into the top discrete compartments 28 while air inlets 38 open into the bottom discrete compartments 28, an air supply test line 40 being operatively connected to each of the air inlets 38.

The top tank assembly 12 includes a conventional fill neck 42 having a pressure cap 44 removably supported therefrom and the pressure neck 42 includes a pressure relief line 46 opening thereinto at its inlet end and into a coolant reserve tank 48 at its outlet end, the pressure relief line 46 including a one-way check valve 50 serially connected therein intermediate its opposite ends allowing flow through the line 46 from the neck 42 to the tank 48 but preventing reverse flow therethrough. The tank 48 includes an inward venting removable cap 52 supported from its fill neck 54 and a lower portion of the tank 48 includes an outlet line 56 branching into two branch lines 58 and 60, the line 58 opening into the lower primary compartment 22 and having a liquid pump 62 serially connected therein and the line 60 opening into the primary compartment 22 of the top tank assembly 12 and having a one-way check valve 64 serially connected therein.

The pump 62 is driven by an electric motor 66 which may be automatically or manually controlled, as desired. Further, an air line 68 opens into an upper portion of the tank 48 and may be controllably supplied air under pressure from any suitable source (not shown). Also, the top tank assembly 12 includes a coolant condition sensor 70 operatively associated therewith and which may sense not only an undesirable increase in the temperature of liquid coolant in the radiator 10 but also an undesirable low level of liquid coolant within the radiator top tank assembly 12.

Figure 4:
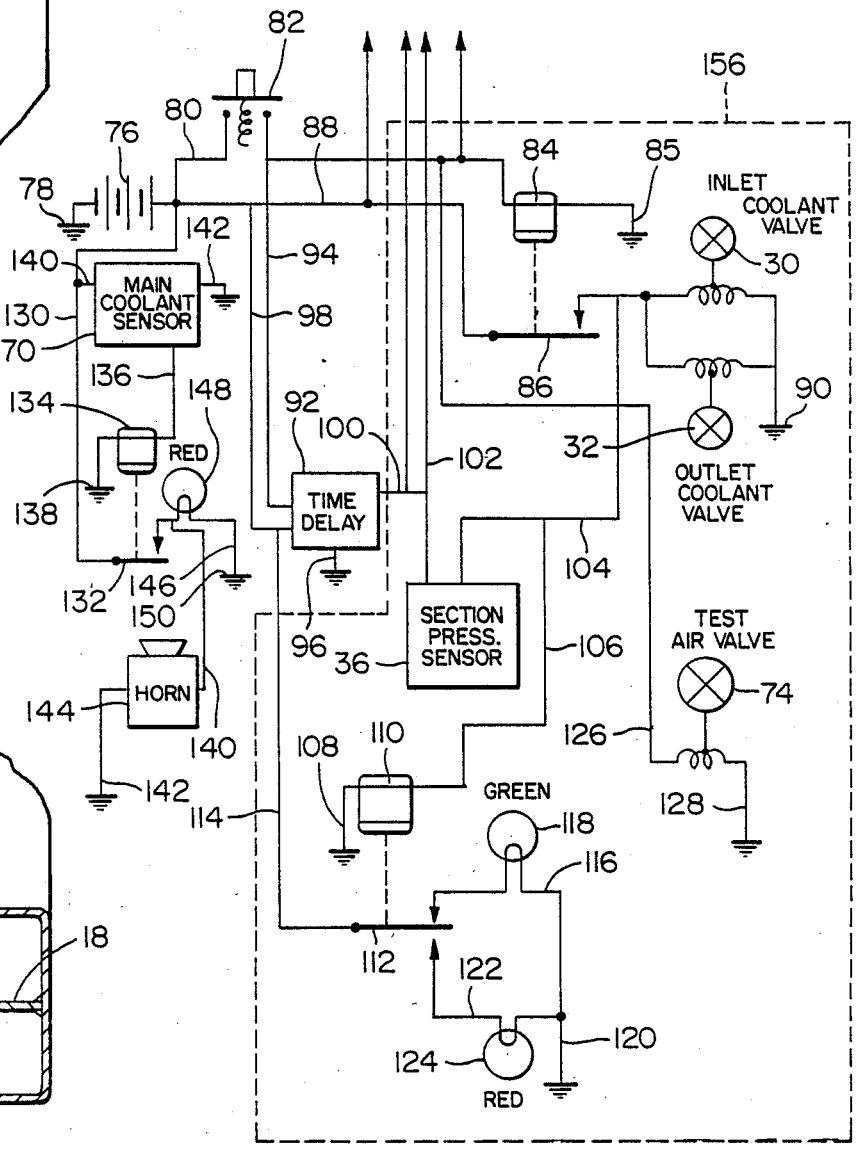
FIG. 4 is a fragmentary diagrammatic view of the undesirable heat transfer condition sensing system and the pressure testing system of the radiator.

With attention now invited more specifically to FIG. 4, the sensor 70 and valves 30 and 32 are illustrated in the diagram shown as well as an electrically controlled valve 74 serially connected in the line 40.

The battery of the associated vehicle (not shown) is designated by the reference numeral 76 and is grounded as at 78. A conductor 80 extends from the battery 76 and has a momentary pushbutton switch 82 serially connected therein as well as a momentary solenoid 84 grounded as at 85. The solenoid 84 is connected to a switch 86 serially connected in a conductor 88 extending from the battery 76 and grounded at 90 and the conductor 88 has one pair of the inlet and outlet valves 30 and 32 connected in parallel therein, the valves 30 and 32 being operative to stay in the last actuated position thereof.

The diagram shown in FIG. 4 also includes one of the pressure sensors 36 as well as a time delay switch 92. The time delay switch 92 is connected in series in a conductor 94 extending from switch 82 and grounded as at 96. In addition, the time delay switch 92 is further electrically connected to the conductor 88 through a conductor 98 and an output conductor 100 extends from the time delay switch 92 and is electrically connected to the pressure sensor 36 by a conductor 102. The pressure sensor 36 has an output conductor 104 electrically connected to the conductor 90 intermediate the valves 30 and 32 and the switch 86 and a conductor 106 extends from the conductor 104 and is grounded at 108 and has a solenoid 110 serially connected therein, the solenoid 110 controlling a switch 112 connected to the conductor 98 by a conductor 114. The switch 112 normally bridges between conductor 114 and a conductor 116 having a green lamp 118 serially connected therein and grounded as at 120. However, actuation of the solenoid 110 will cause the switch 112 to bridge between the conductor 114 and a conductor 122 having a red lamp 124 serially connected therein and grounded at 120. Also, the normally closed air valve 74 is serially connected in a conductor 126 grounded as at 128 and connected to the conductor 80 between the switch 82 and the solenoid 84 and a conductor 130 is connected to the battery 76 at one end and to a switch 132 at the other end under the control of a solenoid 134 serially connected in conductor 136, the conductor 136 extending between the main coolant sensor 70 and ground at 138, the main coolant sensor being electrically connected to conductor 130 by conductor 140 and being grounded at 142. The switch 132 closes upon actuation of the solenoid 134 and bridges the conductor 130 and conductor 140 grounded as at 142 and having an audible signal generator 144 electrically connected therein. Also, the switch 132, when closed, bridges the conductor 130 and conductor 146 having a red lamp 148 serially connected therein and grounded at 150. The solenoid 110 and switch 112 are operably connected in a manner such that the switch 112 will remain in the last actuated position until the solenoid 110 is again actuated.

In operation, and assuming that the radiator 10 is properly filled with liquid coolant, that the coolant reserve tank 48 is substantially filled with a reserve supply of coolant and that the air line 68 is not supplied with air under pressure, the valves 30 and 32 are open and the air valve 74 is normally closed. Furthermore, all of the three switches 112 initially are in the position thereof illustrated in FIG. 4, that portion of the wiring diagram of FIG. 4 bounded by the phantom line 156 being duplicated for each of the sections 34 of the radiator 10.

If a high coolant temperature or low coolant level is sensed by the sensor 70, the main coolant sensor 70 electrically connects the conductor 136 with the conductor 140 and thus activates the solenoid 134 to close the switch 132, thereby actuating the red warming lamp 148 and the audible signal generator 144. At this point, the operator of the associated vehicle (not shown) may close the switch 82 for a short period (approximately two seconds). Closing the switch 82 will supply current to the conductor 94 and activate the time delay switch 92 which is connected to the conductor 88 through the conductor 98. At the same time, the solenoid 84 will be actuated to close the switch 86 and cause the normally open valves 30 and 32 to close. Also, the air valves 74 will be opened for the same period of time sufficient to cause each of the discrete compartments 28, and thus the tube sections 34 to be pressurized.

Thereafter, after a predetermined time, the time delay will close the internal circuit thereof to the conductor 100 and the pressure sensor, if pressure is maintained in the corresponding section of the radiator 10, will close to electrically connect the corresponding conductor 104 with the conductors 100 and 102. This will cause the coolant valves 30 and 32 of each radiator section which maintained proper pressure to be reopened and current also will be supplied to the corresponding conductors 106 thereby actuating the corresponding solenoids 110 to activate the corresponding switches 112 to connect the conductors 114 with the conductors 116 thus actuating the green lamp 118 indicating that the pressure maintaining sections are operative. Of course, if one of the sections 34 does not hold pressure, the corresponding pressure sensor does not close and the corresponding coolant valves 30 and 32 are not reopened and the switch 112 is not actuated to render a green signal as opposed to a red signal.

On the assumption that all of the sections 34 do hold pressure, indicating the possibility of only a slow leak, additional coolant may be added to the system by operating the liquid pump 66 by a remote control (not shown) therefore. During operation of the pump 62, reserve supply coolant from the tank 48 may be pumped into the lower primary compartment 22 and up through the bottom discrete compartments 28 and the tube core sections 34 and into the discrete compartments 28 and thereafter into the upper primary compartment 22, the pump 62 being capable of discharging coolant there from at approximately 18 psi and the pressure cap 44 comprising a 16 psi pressure cap so that any air entrapped in the upper portion of the upper primary compartment 22 will be discharged there from through the pressure relief line and back into the tank 48. In addition, air may be supplied to the interior of the tank 48 through air line 86 sufficient to cause coolant to be express therefrom and through the line 58 into the bottom primary compartment 22. The liquid coolant forced from the tank 48 and into the primary the compartment 22 by air pressure will be at a pressure somewhat higher than 16 psi and thereafter the pressure of air within the tank 48 above the liquid coolant therein maybe vented to ambient pressure, at which time excess air pressure within the upper primary compartment 22 above 16 psi will be vented from the cap 44, through the line 46 and into the tank 48. Thereafter, the tank 48 again may be pressurized with air in order to force additional quantities of a liquid coolant there from and into the lower primary compartment 22. This procedure may be repeated as many time as is necessary to substantially fill the upper primary compartment 22.

If, on the other hand, one of the tube core sections 34 or discrete compartments 28 does not retain pressure, that discrete compartment and the companion discrete compartment 28 and tube core section 34 will be maintained closed by the inlet and outlet valves 30 and 32 thereof and continued cooling of the associated engine will be carried out through the remaining two tube core sections 34, which remaining two tube core sections 34 may be again filled with liquid coolant from tank 48 through usage of the pump 62 as previously described.

Of course, if it is desired, the pump 62 may be omitted and the discharge end of the pressure relief line 46 may be vented to atmosphere, whereby only air pressure is needed to force reserve coolant from the tank 48 into the radiator 10.

Still further, the radiator 10 may include more than 3 tube core sections 34 and attendant pairs of discrete compartments 28. In any event, the radiator 10 initially will be designed such that its cooling capacity is a least 50 percent greater than the expectant coolant demand thereon. Thus, the radiator 10 will be wholly operative to perform its intended cooling operation, even if one of the tube core sections develops a leak and must be isolated from the remaining two tube core sections 34.

The foregoing is considered as illustrative only of principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A radiator with leak detecting and isolating system, said radiator including a tube core having opposite ends and end tanks sealingly secured to said ends and into which said ends open, said tube core including a plurality of discrete tube sections, communicating means individually communicating each discrete tube section end with the corresponding end tank, said communication means including a liquid flow controlling valve operatively associated with each discrete tube section end and the corresponding end tank for controlling the flow of liquid therebetween, heat transfer liquid condition sensing means operative to sense an undesirable condition of heat transfer liquid in said system, actuating means operative to close each of said liquid flow controlling valve responsive to said heat transfer liquid condition sensing means sensing an undesirable condition, gas pressure means operative to pressurize each of said discrete tube sections, pressure sensing means operatively associated with each discrete tube section to sense a pressure in the corresponding tube section after being pressurized by said gas pressure means, and control means operative to open the liquid flow controlling valves to each of said discrete tube sections in which a pressure is sensed while maintaining the flow controlling valves of each discrete tube section with no pressure sensed closed.

2. A radiator with leak detecting and isolating system, said radiator including a tube core having opposite ends and end tanks sealingly secured to said ends and into which said ends open, said tube core including a plurality of discrete tube sections and said end tanks each including a plurality of discrete secondary compartments into which the corresponding ends of said tube sections open, said end tanks also including primary compartments therein into and from which heat transfer liquid is received and discharged, communication means within each tank communicating each of said secondary compartments with the corresponding primary compartment within each tank for liquid flow therebetween, said communication means each including a liquid flow controlling valve, heat transfer liquid condition sensing means operative to sense an undesirable condition of heat transfer liquid in said system, actuating means operative to close each of said liquid flow controlling valves responsive to said heat transfer liquid condition sensing means sensing an undesirable condition, gas pressure means operative to pressurize each of said discrete tube sections, pressure sensing means operatively associate with each discrete tube section to sense a pressure in the corresponding tube section after being pressurized by said gas pressure means, and control means operative to open the liquid flow controlling valve to each of said discrete tube sections in which a pressure is sensed while maintaining those with no pressure sensed closed.

3. The radiator of claim 2 wherein said control means also include means for simultaneous actuation of said actuating means.

4. The radiator of claim 2 wherein said control means includes means operative to automatically actuate said actuating means to open only those liquid flow controlling valves to the tube sections in which a pressure is not sensed after a predetermined time period subsequent to the liquid flow controlling valves all being closed and said tube sections being pressurized.

5. The radiator claim 4 wherein said control means also include means for simultaneous actuation of said actuating means.

6. The radiator of claim 2 including liquid coolant supply means operative to admit heat transfer liquid from a reserve liquid coolant reservoir into a first of said primary compartments at a greater pressure than the pressure of liquid therein.

7. The radiator of claim 6 wherein one primary compartment of said radiator includes a pressure relief-type outlet for venting vapor from said one primary compartment responsive to a pressure increase therein above a predetermined pressure, said greater pressure being greater than said predetermined pressure.

8. The radiator of claim 2 wherein said heat transfer liquid condition sensing means includes means operative to sense excess temperature of the heat transfer liquid in said system.

9. The radiator of claim 2 wherein said heat transfer liquid condition sensing means includes means operative to sense low volume of liquid in said system.

10. The radiator of claim 2 wherein said heat transfer liquid condition sensing means is operative to sense excessive temperature of heat transfer liquid in said system and low volume of liquid in said system.

11. The radiator of claim 2 including liquid coolant supply means operative to admit heat transfer liquid from a reserve liquid coolant reservoir into a first of said primary compartments at a greater pressure than the pressure of liquid therein, one primary compartment of said radiator including a pressure relief-type outlet for venting vapor from said one primary compartment responsive to a pressure increase therein above a predetermined pressure, said greater pressure being greater than said predetermined pressure, said first primary compartment comprising the other of said primary compartments, said pressure relief-type outlet discharging into said reserve liquid reservoir.

12. The radiator of claim 11 wherein said radiator other primary compartment includes liquid coolant inlet means for receiving heated liquid coolant from the coolant passages of an associated combustion engine and said one primary compartment includes liquid outlet means for discharging cooled liquid coolant to the coolant passages of said combustion engine.

* * * * *